US006726000B2

(12) United States Patent
Reist et al.

(10) Patent No.: US 6,726,000 B2
(45) Date of Patent: Apr. 27, 2004

(54) METHOD OF, AND APPARATUS FOR, RAISING SHEET-LIKE PRODUCTS

(75) Inventors: Walter Reist, Hinwil (CH); Willi Leu, Pfaffikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/220,696

(22) PCT Filed: Jan. 23, 2001

(86) PCT No.: PCT/CH01/00048

§ 371 (c)(1),
(2), (4) Date: Nov. 22, 2002

(87) PCT Pub. No.: WO01/64566

PCT Pub. Date: Sep. 7, 2001

(65) Prior Publication Data

US 2003/0146564 A1 Aug. 7, 2003

(30) Foreign Application Priority Data

Mar. 3, 2000 (CH) ..... 415/00

(51) Int. Cl.[7] ..... B65G 15/00; B65G 17/00; B65G 29/00; B65G 47/24; B65G 47/86

(52) U.S. Cl. ..... 198/408; 198/411; 198/379; 271/187

(58) Field of Search ..... 198/404, 408, 198/411, 379, 470.1, 644; 271/182, 187

(56) References Cited

U.S. PATENT DOCUMENTS

| | | | | |
|---|---|---|---|---|
| 3,713,650 A | | 1/1973 | Hodgkinson et al. | |
| 4,320,894 A | | 3/1982 | Reist et al. | |
| 5,065,994 A | | 11/1991 | Hatt | |
| 5,248,135 A | | 9/1993 | Leu | |
| 5,292,111 A | | 3/1994 | Hansch | |
| 5,388,816 A | | 2/1995 | Petersen | |
| 5,485,989 A | | 1/1996 | McCay et al. | |
| 5,620,081 A | * | 4/1997 | Kivits | 198/404 |
| 6,003,859 A | | 12/1999 | Reist | |

FOREIGN PATENT DOCUMENTS

| | | |
|---|---|---|
| DE | 640559 | 12/1936 |
| DE | 10 35 572 B | 7/1958 |
| DE | 1035572 | 7/1958 |
| DE | 10 93 296 B | 11/1960 |
| DE | 1093296 | 11/1960 |
| DE | 640 559 | 12/1993 |
| EP | 0 476 859 A2 | 3/1992 |
| EP | 0 572 221 A1 | 12/1993 |
| EP | 0 644 142 A1 | 3/1995 |
| EP | 0 708 042 A1 | 4/1996 |

* cited by examiner

*Primary Examiner*—Gene O Crawford
(74) *Attorney, Agent, or Firm*—Brinks Hofer Gilson & Lione

(57) ABSTRACT

Method of raising sheet-like products (2), in particular printed products, which are taking part in a conveying process and follow sequentially one after the other, the products (2) resting, at least in certain regions, on a conveying means (1) during the conveying process, it being the case that, for at least a period of time of the raising operation, gravitational force being overcome in the process, the products (2) are pivoted actively about an axis (B) which extends essentially parallel to the direction (A) in which the conveying process is oriented immediately prior to the raising operation.

24 Claims, 11 Drawing Sheets

METHOD OF, AND APPARATUS FOR, RAISING SHEET-LIKE PRODUCTS

RELATED APPLICATIONS

Figure 1:
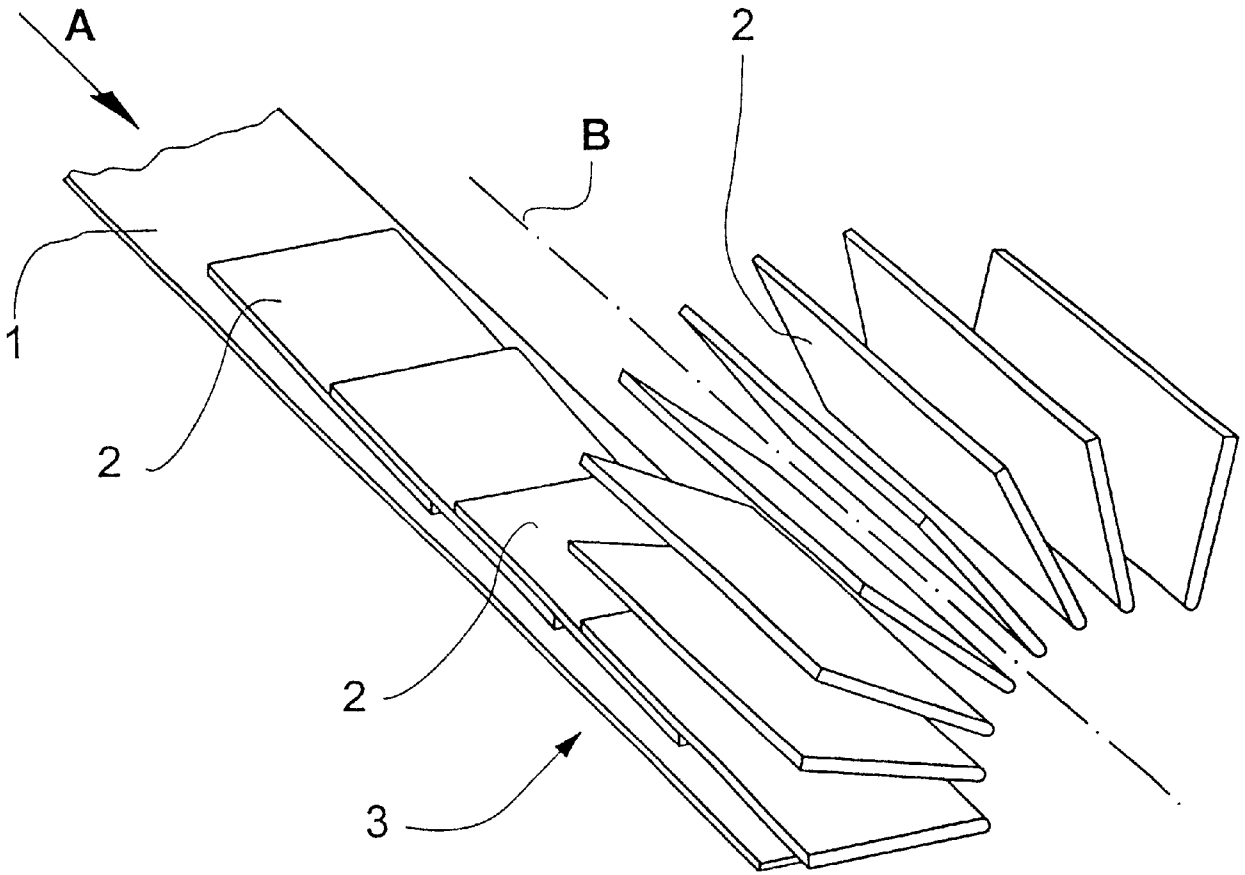

This application is a nationalization of PCT application PCT/CH01/00048 filed Jan. 23, 2001. This application claims priority from the PCT application and Swiss Patent Application No. 2000 0415/00 filed Mar. 3, 2000.

The invention relates to a method of, and an apparatus for, raising sheet-like products, in particular printed products, which are taking part in a conveying process and follow sequentially one after the other, the products resting, at least in certain regions, on a conveying means during the conveying process.

In certain application cases, it is necessary for products transported, for example, on a conveying belt to be turned through 180° in relation to an axis parallel to the conveying direction. This is achieved according to the prior art, for example, by so-called "rotary belts" in which the products are retained between two belts which are twisted parallel to one another through 180° along the conveying direction. In order to avoid damage to the products and to ensure reliable turning, these rotary belts have to extend over a relatively large region of the conveying belt, which is disadvantageous in respect of the amount of space taken up by the turning apparatus.

In other application cases, it is necessary for the conveying direction of products transported, for example, on a conveying belt to be changed abruptly by a predetermined angle, in particular by an angle of 90°. According to the prior art, this is achieved, for example, in that running at the end of the first conveying belt is a second conveying belt, which extends at right angles to the first conveying belt and of which the conveying plane is arranged beneath the conveying plane of the first conveying belt, with the result that the products can drop onto the second conveying belt and thus change their conveying direction by 90°. It is disadvantageous here, for example, that the products drop between the two conveying planes in an uncontrolled manner, which may result in disruption. It is further disadvantageous that for example, if when the conveying direction is changed, upstream or downstream, the products are also to be turned, this can only be achieved by means of separate turning apparatuses or rotary belts, which in turn is disadvantageous in respect of the amount of space taken up. The same applies if when the conveying direction is changed, upstream or downstream, the products are to be rotated about an axis running perpendicularly to the conveying plane or a combination of the abovementioned operations of changing the conveying direction, turning and/or rotating are to take place in any desired time sequence.

It is an object of the invention to develop a method of the type mentioned in the introduction such that products supplied sequentially by a conveying means can be processed further individually with reduced mechanical outlay, the intention also being, in particular, to achieve the situation where the conveying means is only overlapped to a slight extent, if at all, by the apparatus for raising the products.

This object is achieved according to the invention in that, during at least a period of time of the raising operation, gravitational force being overcome in the process, the products are pivoted actively about an axis which extends essentially parallel to the direction in which the conveying process is oriented immediately prior to the raising operation.

At the beginning of the raising operation, a redirection of the movement of the products thus takes place to the effect that the forward movement brought about by the conveying process is slowed down, and a laterally oriented pivoting movement commences during this slowing-down operation. For this pivoting movement, which is oriented laterally in relation to the direction of the conveying process, the product has to be fed potential energy at least for a period of time, with the result that it is possible for the products to be pivoted upward during the above-mentioned period of time. Once the abovementioned period of time has elapsed, the products thus have higher potential energy than prior to this period of time.

Since the pivoting of the products commences in each case when a product arrives at a defined position or at the end of the conveying means, all the products are pivoted individually one after the other, with the result that, with products following one after the other quickly or in imbricated formation, a fan-like structure is produced during the pivoting operation, each fan element of said structure being formed by precisely one product in each case, with the result that it is easily possible for the individually fanned-out products to be further processed individually. This is because, once the products have executed the pivoting movement according to the invention, they can easily be, for example, gripped and removed individually from their individually fanned-out structure or deposited individually on a further conveying means.

Instead of individual products being conveyed and pivoted, it is also possible for groups of products to be conveyed and/or pivoted in each case. The product groups here may be formed during the conveying operation preceding the pivoting operation, with the result that even the conveying operation takes place in groups. It is also possible, however, for the product groups only to be formed immediately prior to commencement of the pivoting operation or even during the pivoting operation, which means that, shortly prior to or during the pivoting operation, individual products following one after the other, for example, in imbricated formation are pushed essentially congruently one above the other to form groups.

The pivoting movement provided according to the invention further achieves the situation where the transfer between two conveying means which follow sequentially one after the other can take place with an extremely small amount of space being required since the two conveying means only need to overlap one another slightly, this overlapping being, for example, in the order of magnitude of the longitudinal extent of a product in the conveying direction.

It is advantageous if the pivot axis which is decisive for the pivoting movement according to the invention coincides at least essentially with a product edge which extends parallel to the direction in which the conveying process is oriented immediately prior to the raising operation. In this case, the products are pivoted about one of their edges, which, on the one hand, means that the pivoting movement can be executed with a minimal amount of space being required and, on the other hand, advantageously results in the products only having to be accelerated to an unproblematic extent. In this case, the edge about which the pivoting movement takes place is advantageously not accelerated at all in practice.

Immediately prior to the beginning of the raising operation, the products may be oriented horizontally or in a manner inclined in relation to the horizontal. It is advantageous here if the products rest with their surface area on a correspondingly oriented conveying means, in particular a conveying belt.

It is likewise possible, however, to convey the products by means of grippers, which then transfer the products, for the purpose of the pivoting operation according to the invention, to a corresponding pivoting apparatus. These grippers can retain the products, for example, at one or two edges.

Throughout the pivoting movement, the products are preferably pivoted through an angle of between 10° and 270°, the raising-operation period of time, over which the gravitational force is overcome, usually always accounting for an angle range of between 10° and 90°. It is thus possible according to the invention for the products first to be raised through an angle range of between 10° and 90° and then to be pivoted downward, for example assisted by gravitational force, through an angle range of between 90° and 180°.

In order for it to be possible for the pivoting movement according to the invention to be executed in a defined manner, it is possible, during this pivoting movement, for the products to be retained at least temporarily, in particular at their leading edge, as seen in the conveying direction, by suitable means, e.g. by supporting means or grippers, which cause the products to pivot and pivot along with said products. In particular each product here is assigned an individual gripper, of which the movement, ultimately, determines the speed of the pivoting movement of the products. Immediately prior to the beginning of the pivoting movement, the products may be moved, by way of their leading edge, into the gripper by the conveying movement. It is likewise possible for a suitable apparatus to guide the grippers, counter to the conveying movement, up to the leading edge of the products in order then to grip the latter.

It is preferred if, at the beginning of the raising operation, the products are moved, by way of their leading edge, against an in particular stationary stop, with the result that the products, at least in certain regions, lift off from the conveying means in the pivoting direction. This stop thus initiates the pivoting movement according to the invention in that, for example in a region of the leading edge of the products which is directed away from the pivot axis, it prevents further movement in the conveying direction, which results in the products "bulging out" upward on account of the action of friction between the conveying means and products. This bulging out takes place in each case in a defined direction away from the conveying means, with the result that the abovementioned stop triggers a controlled and defined initiation of the pivoting movement, whereupon the rest of the pivoting movement in the upward direction can take place in a controlled manner by way of a gripper or a suitable supporting means.

It is particularly preferred if, at the beginning of the raising operation, products having an overfold are only moved against a stop of the abovementioned type by way of the leading edge of their overfold region, with the result that that region of the products which is located opposite the overfold lifts off from the overfold in the pivoting direction and the products are thus made to open. In this case, the stop thus results both in the pivoting movement being initiated and in the products being opened.

As an alternative, or in addition, to the abovedescribed stop, it is also possible to provide, in the region of the conveying means, an in particular stationary guide element, along which the products are moved by way of their leading edge at the beginning of the raising operation. The guide element causes, at least in certain regions, the products to be raised from the conveying means in the pivoting direction. If then a stop is also provided in addition, for example at the end of the guide element located in the conveying direction, products with an overfold can first of all be raised by the guide element, whereupon the raised products are then opened by way of the overfold butting against the stop, with the result that the products can easily be gripped, for example, by a three-finger gripper, in each case one finger of the gripper ending up on the two outer sides of the product and one finger ending up between the overfold region and the region located opposite the overfold region.

During the conveying process preceding the pivoting movement, the products may be transported both in imbricated formation and without overlapping one another. In order to implement the method according to the invention, all that is necessary is for individual products or product groups to follow sequentially one after the other.

Once they have been raised into an at least essentially vertically oriented position, the products may each be gripped individually by grippers, in particular at an upwardly oriented edge, and fed for further processing. It is possible here for the conveying direction of the corresponding gripper section to run essentially perpendicularly to the direction in which the conveying process is oriented immediately prior to the raising operation.

Once the products have been raised into an at least essentially vertically oriented position, however, it is also possible for the products to be pivoted downward assisted by gravitational force, it being possible for this pivoting operation to take place about the same pivot axis as the preceding raising operation. The downward pivoting operation assisted by gravitational force takes place here, in particular, through an angle range of between 90° and 180°. Following the downward pivoting operation, the products may be deposited on a further conveying means or a product stack.

Particularly cost-effective functioning of the method according to the invention is achieved when, during the pivoting movement taking place counter to gravitational force and/or during the pivoting movements assisted by gravitational force, the products are processed, in particular opened, stapled, addressed, cut or the like. In this case, the pivoting movement is not just utilized for lifting off the products from the conveying means; at the same time, it is also possible for processing to take place during the pivoting movement, time being saved in this way.

If folded products are opened during the pivoting movement, it is advantageous if the fold region of the products ends up in the radially inward direction in relation to the pivoting movement. In a particular variant of the method according to the invention, it is then possible, during the pivoting movement, for already open products to have further products inserted into them.

Following the pivoting movement according to the invention, the products—as has already been mentioned—may be deposited, for example, on a further conveying means. In this case, the conveying direction of this further conveying means may run essentially perpendicularly, or else also parallel, to the direction in which the conveying process was oriented immediately prior to the raising operation. The conveying direction of the products may thus be changed, for example, by 0°, 90°, 180° or 270° by means of the method according to the invention. The further conveying means may be designed, for example, as a gripper section, as a pocket conveyor, as a saddle conveyor, as a combined pocket and saddle conveyor or else also as a conveying belt.

Further preferred embodiments of the method according to the invention are described in the subclaims.

Figure 2:
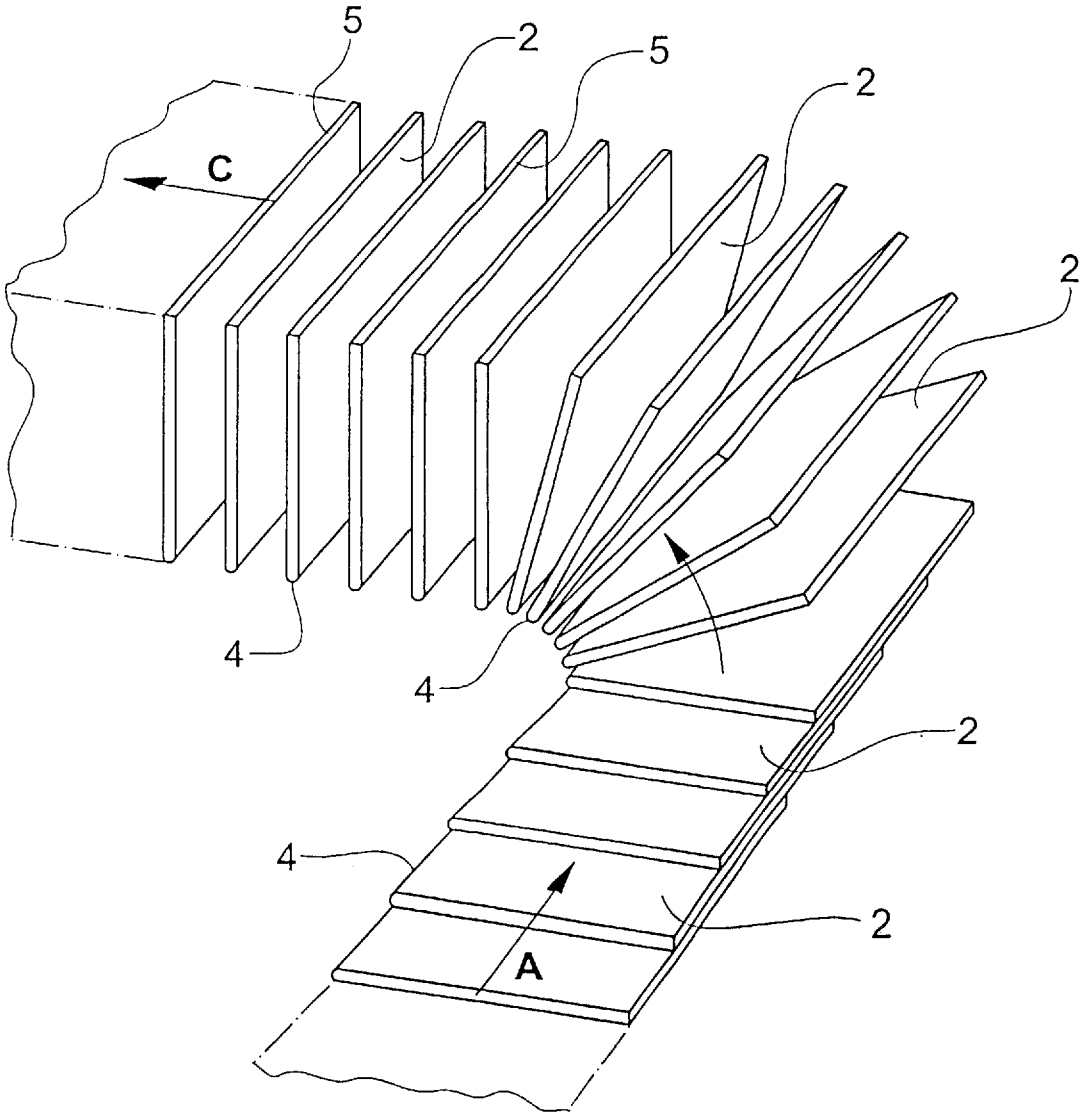
Figure 2A:
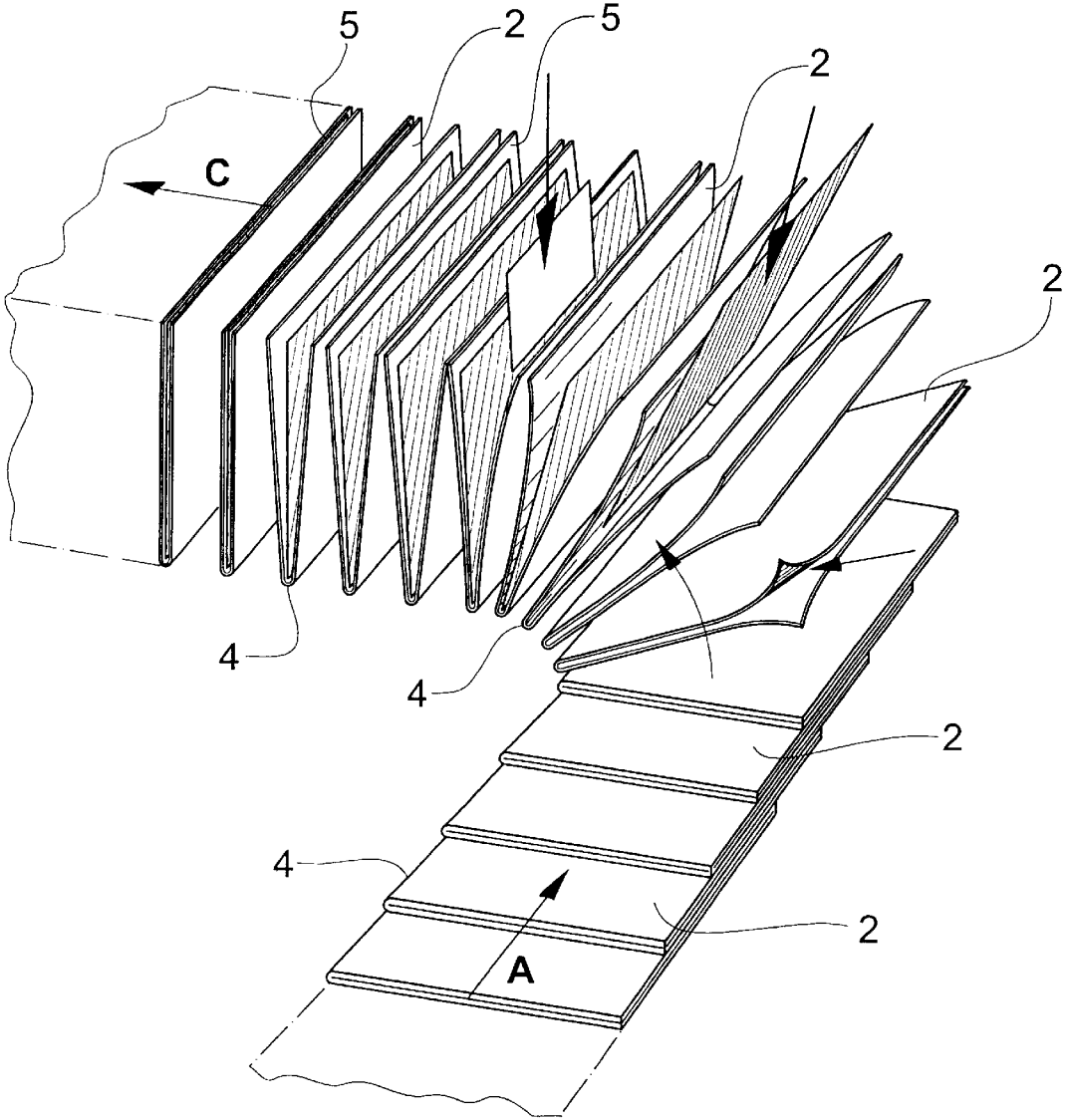
Figure 3:
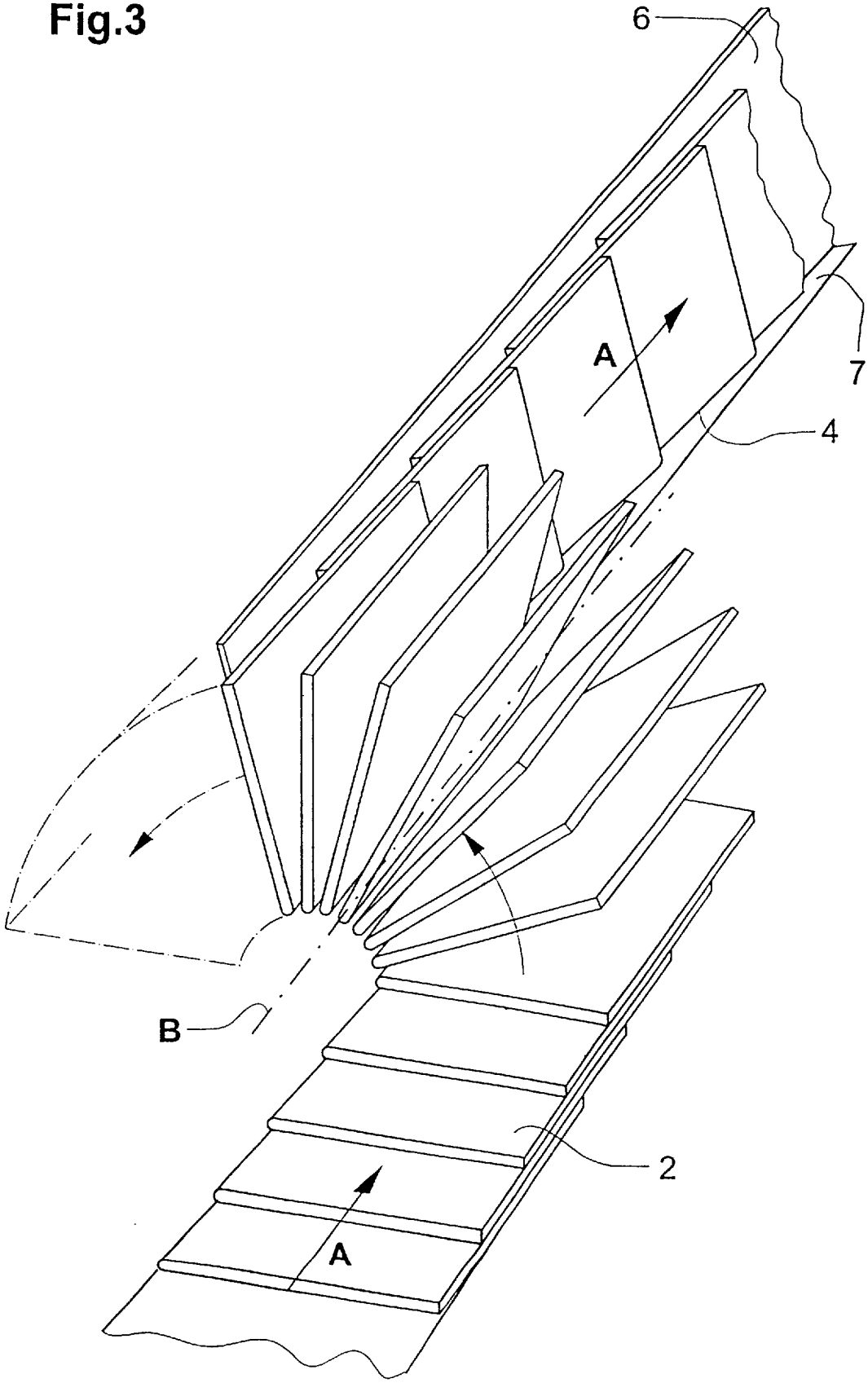
Figure 4:
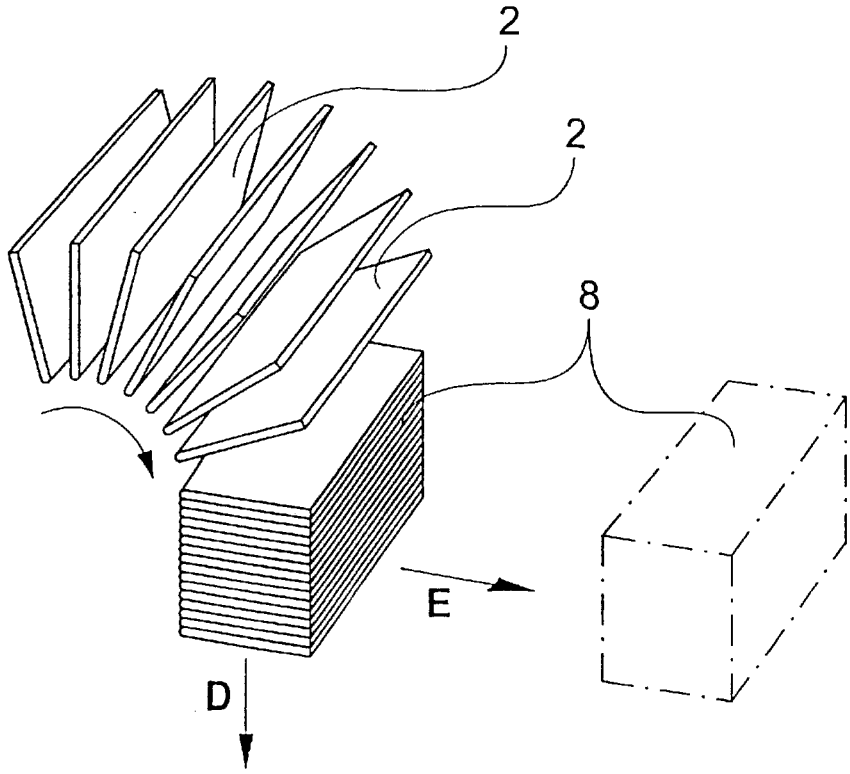
Figure 5:
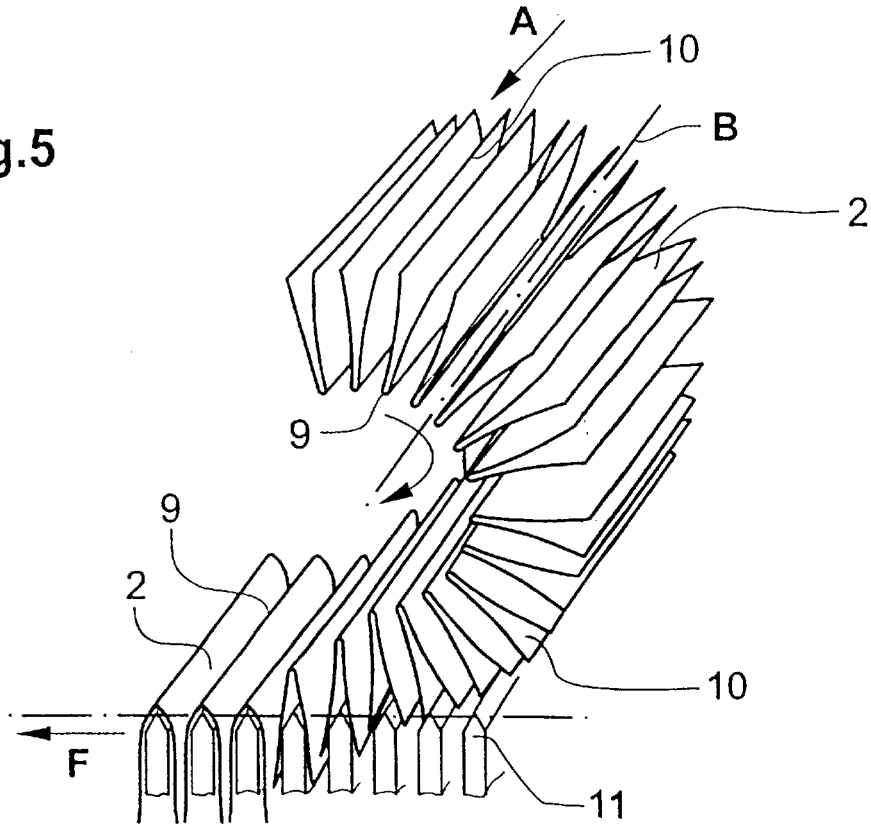
Figure 6:
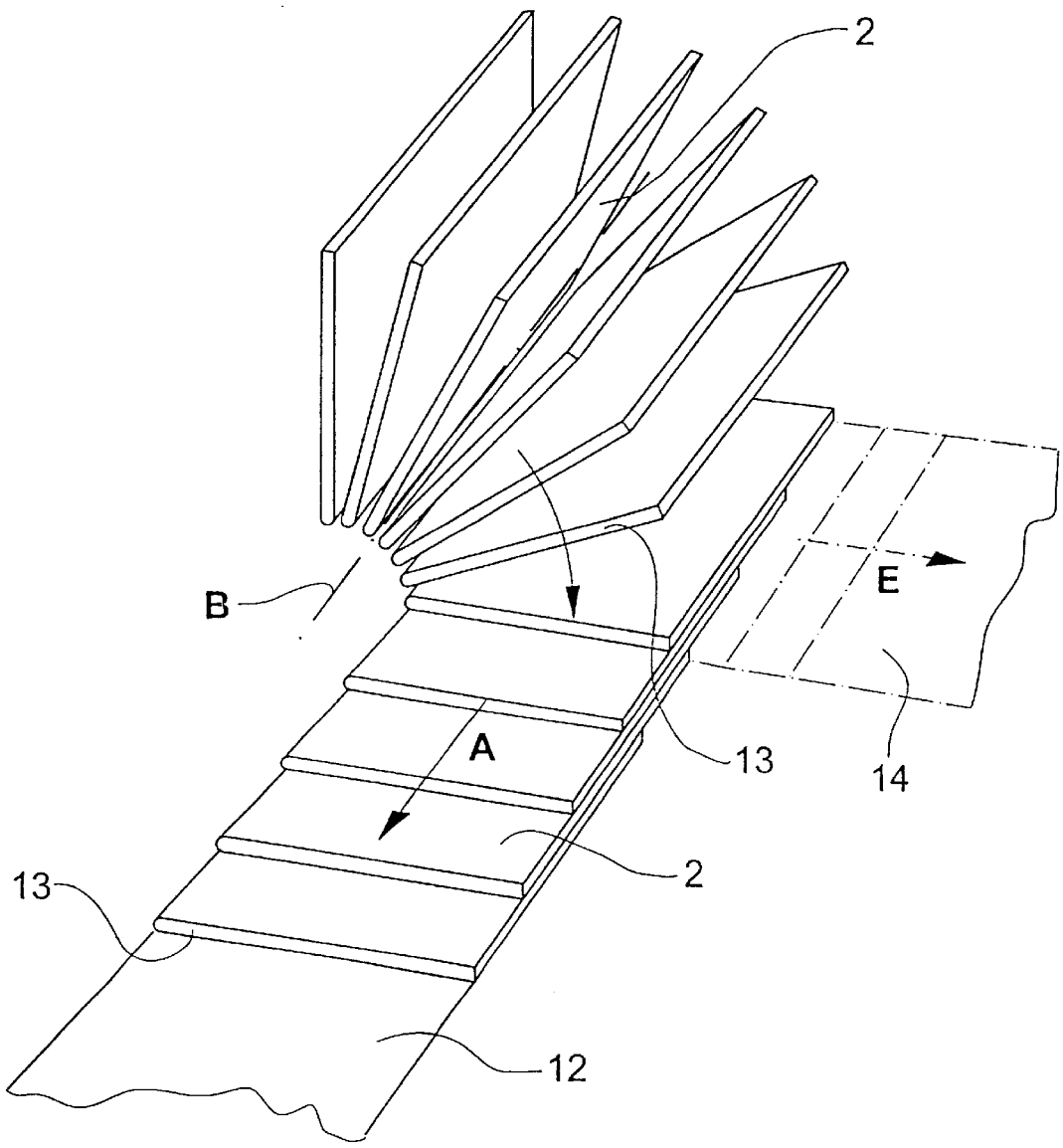
Figure 7:
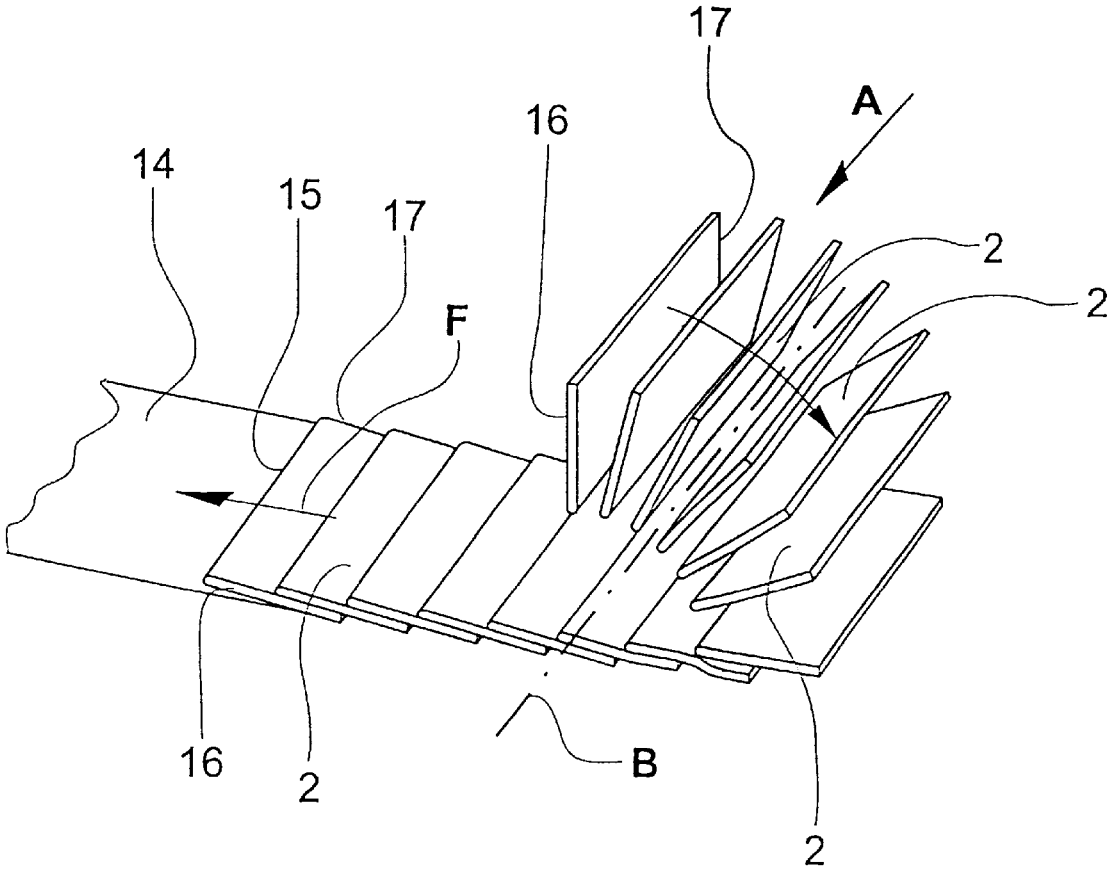
Figure 8:
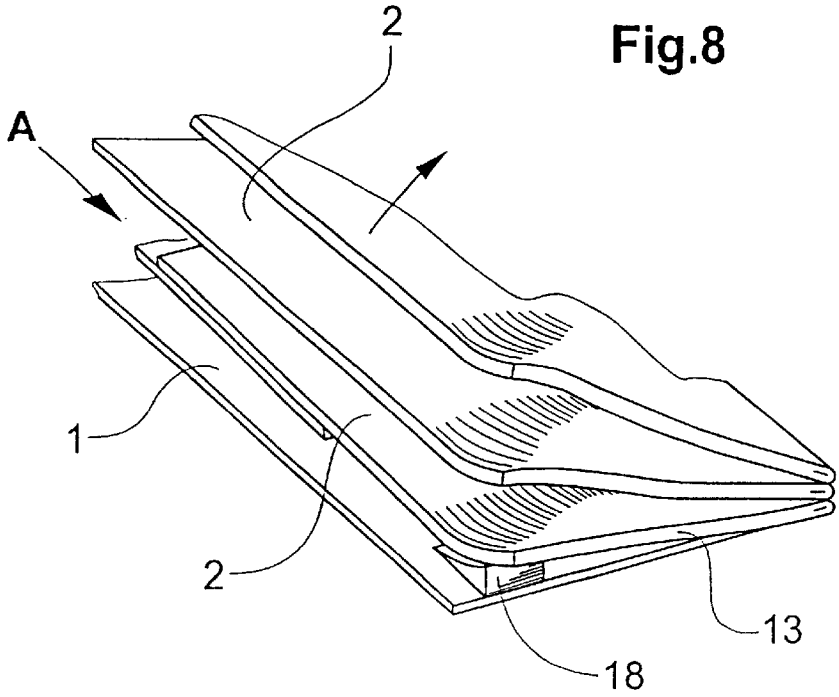
Figure 9:
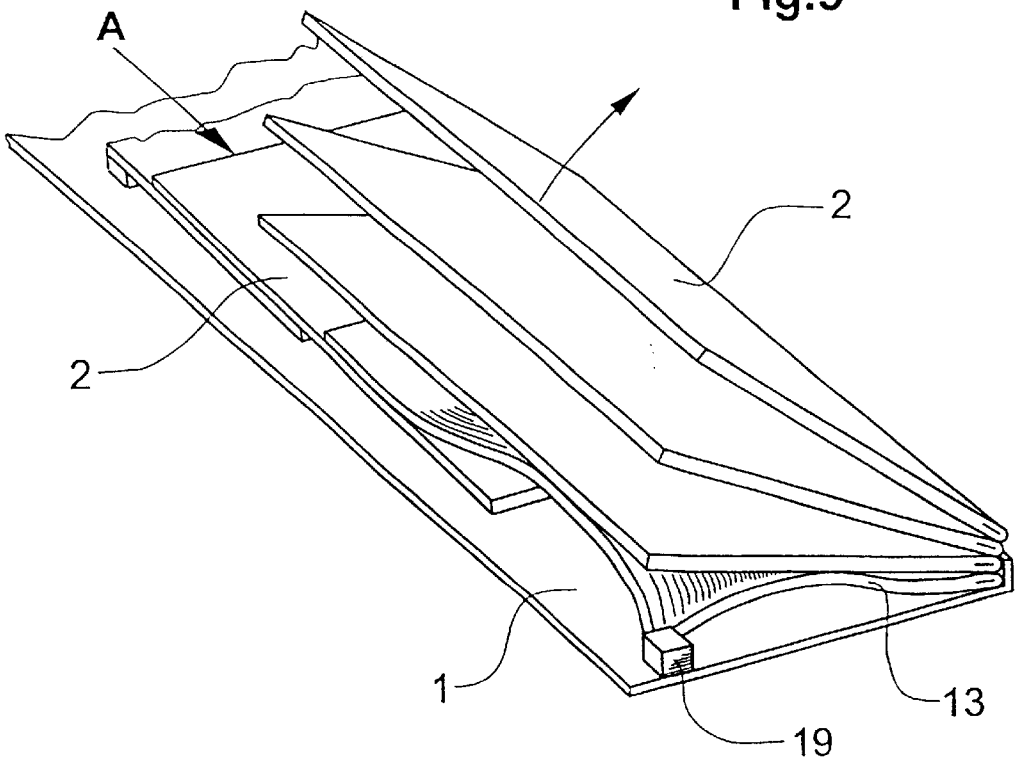
Figure 10:
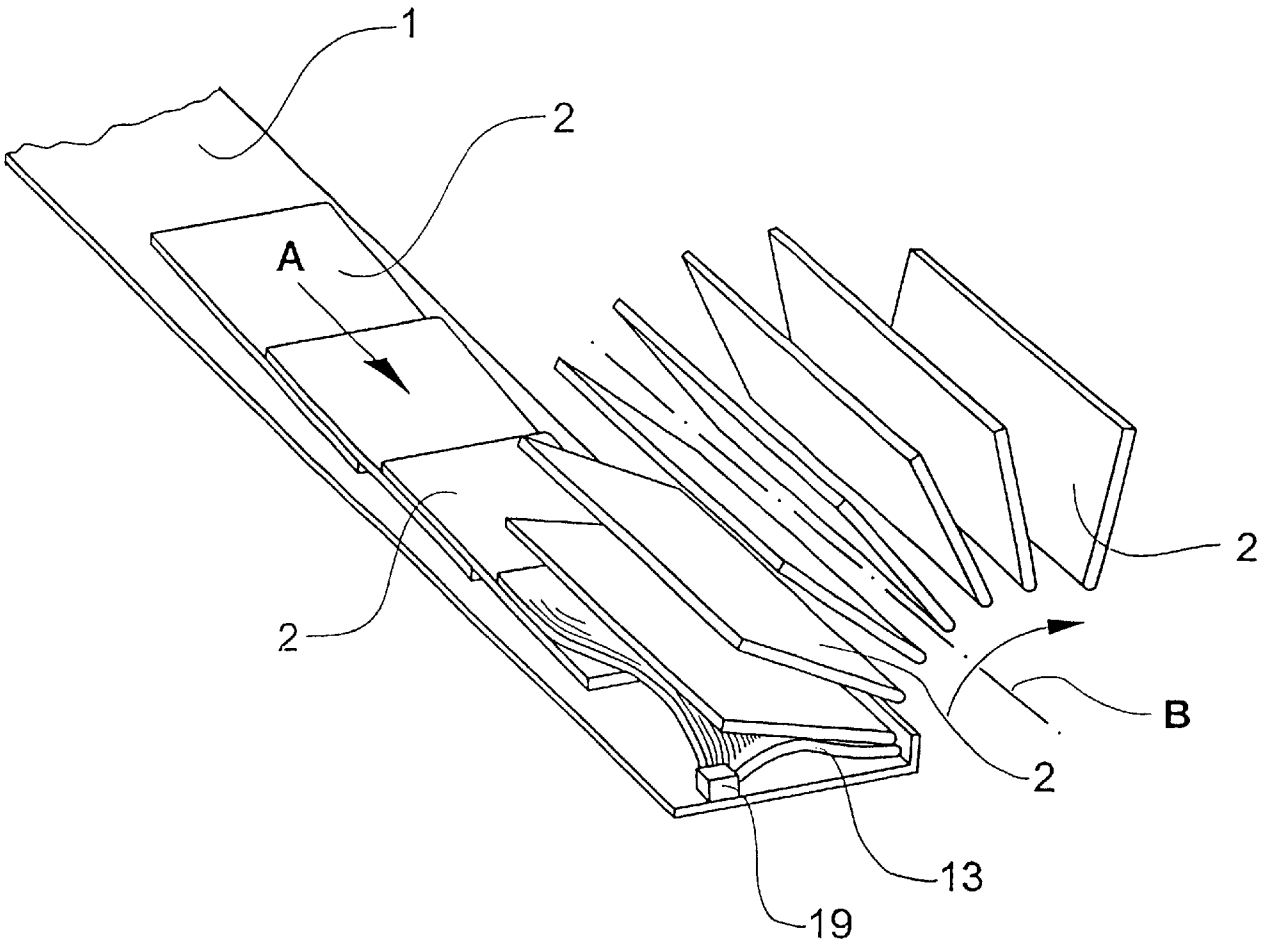
Figure 11:
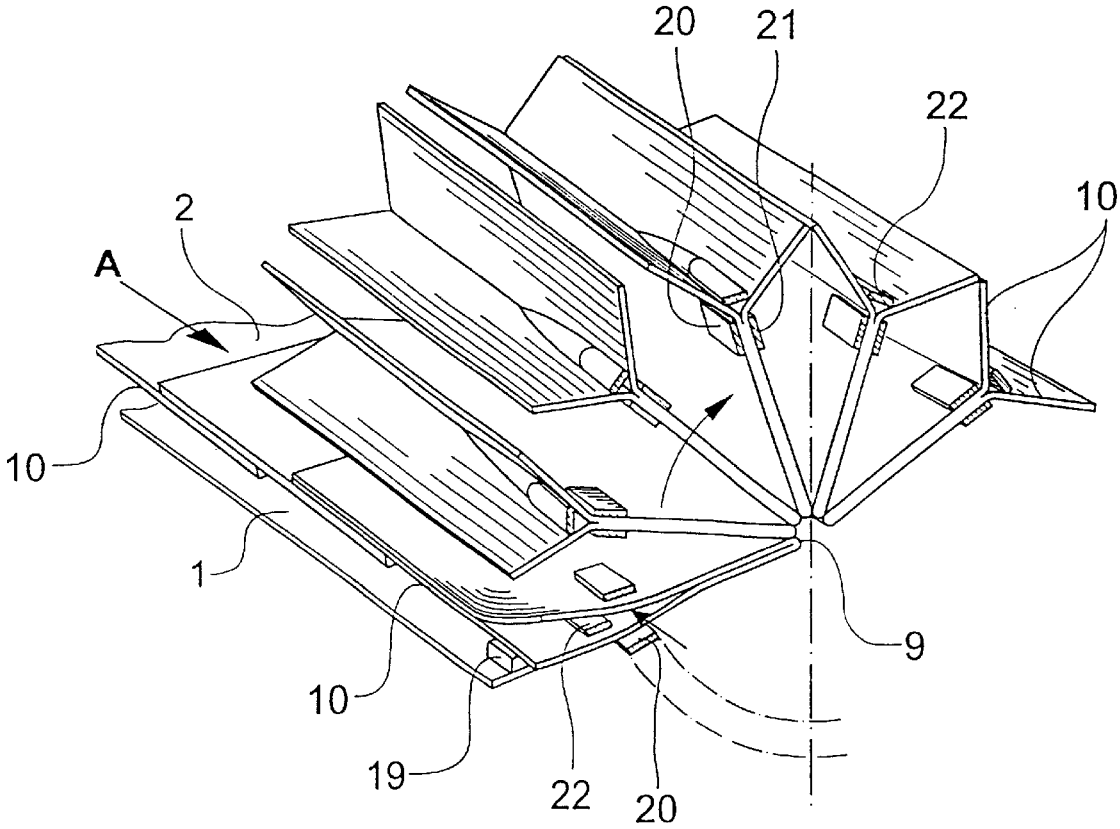
Figure 12:
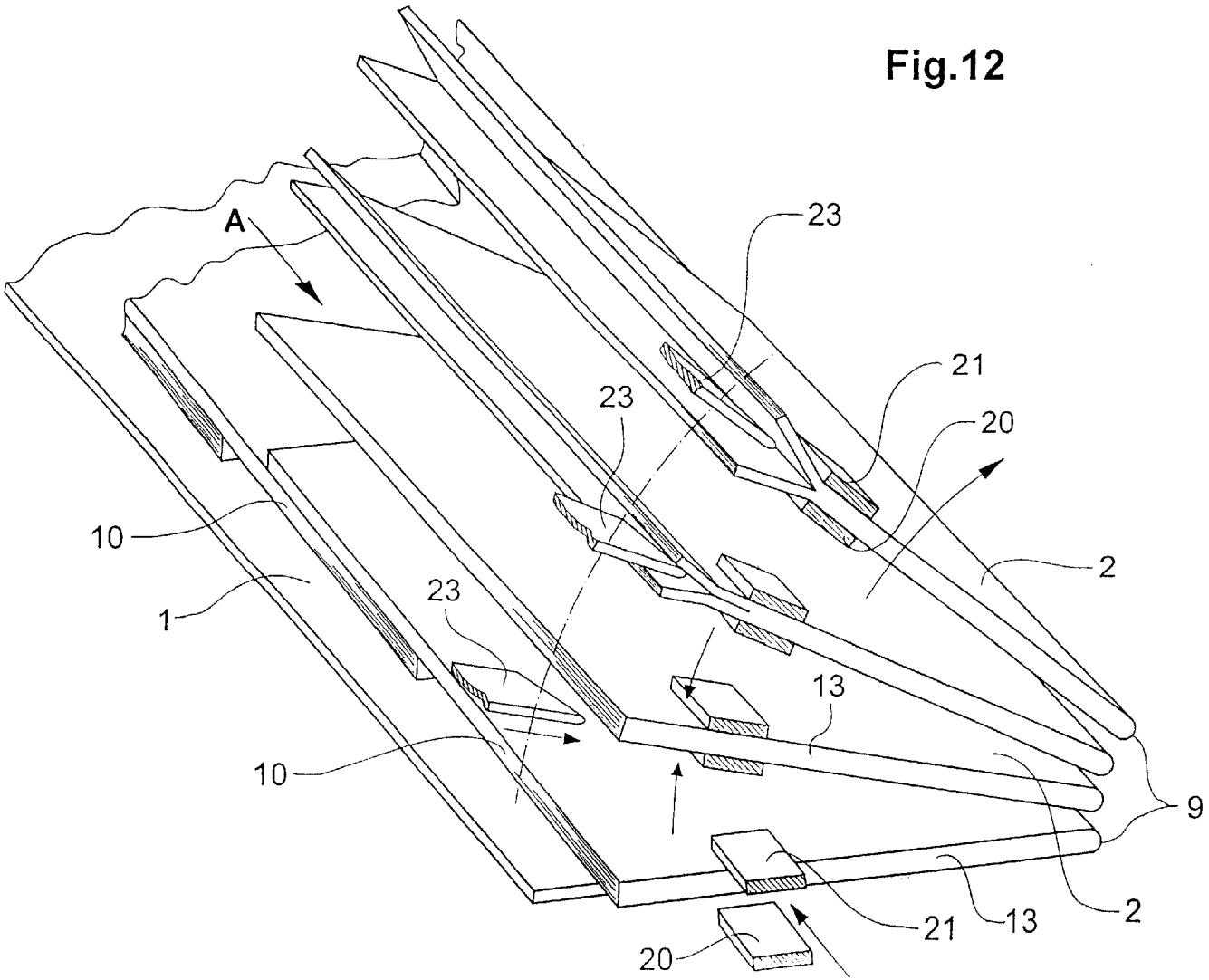

The invention is explained hereinbelow by way of exemplary embodiments and with reference to the drawings, in which:

FIG. 1 shows a schematic illustration of the course taken by a first variant of a method according to the invention, FIG. 2 shows a schematic illustration of the course taken by a second variant of a method according to the invention, FIG. 3 shows a schematic illustration of the course taken by a third variant of a method according to the invention, with a first and a further conveying means, FIG. 4 shows a schematic illustration of a second method step of a method according to the invention, this step being used for stack formation, FIG. 5 shows a schematic illustration of a second method step of a method according to the invention, incorporating an opening process with a further conveying means designed as a saddle conveyor, FIG. 6 shows a schematic illustration of a second method step of a method according to the invention, with a further conveying means designed as a conveying belt, FIG. 7 shows an illustration according to FIG. 6 with a conveying belt running in an alternative direction to FIG. 6, FIG. 8 shows the end of a conveying means, which can be used within the context of the invention, with a guide element arranged in its end region, FIG. 9 shows the end of a conveying means, which can be used within the context of the invention, with a stop arranged in its end region, FIG. 10 shows a schematic illustration of the course taken by a method according to the invention, with a horizontally oriented conveying means having a stop at its end, FIG. 11 shows a schematic illustration of the course taken by a method according to the invention, with a detailed illustration of the opening process, and FIG. 12 shows a schematic illustration of an opening process with alternative means to FIG. 11.

FIG. 1 shows a schematic illustration of a conveying means 1 which is arranged in a horizontal plane and by means of which printed products 2 are moved in imbricated formation in the conveying direction A. The printed products 2 are moved, by the conveying means 1, into the end region 3 of the latter, where the movement of the printed products 2 in the conveying direction A terminates and a pivoting movement about the axis B, which extends parallel to the conveying direction A, commences. The pivot axis B may coincide with an edge of the products 2 which runs in the conveying direction A; however, it is also possible—as is illustrated in FIG. 1—for it to be spaced apart from the abovementioned edge.

FIG. 1 shows that, at the beginning of the pivoting movement, gravitational force being overcome in the process, the products 2 have to be raised by the conveying means 1 over an angle range of approximately 90° until they are located essentially vertically, whereupon further processes may then commence, these further processes being explained by way of example in conjunction with the following figures.

FIG. 2 shows a variant of the method according to FIG. 1, in the case of which products 2 transported up horizontally in direction A are pivoted upward through approximately 90° about a product edge 4 running in the conveying direction A, with the result that this pivoting movement takes up less space than the pivoting movement according to FIG. 1. The products 2 pivoted upward in the abovementioned manner are then conveyed further in direction C in essentially vertically alignment and at a space from one another, the direction C extending perpendicularly to the direction A. The conveying movement in direction C can be brought about, for example, by means of grippers (not illustrated) which grip the products 2 at their top product edge 5, with the result that the products 2 can be transported in the hanging state in direction C.

FIG. 3 likewise shows products 2 which are transported up in direction A and—as is also the case with the products according to FIGS. 1 and 2—are conveyed in imbricated formation. These products 2 are pivoted upward through somewhat more than 90° about a pivot axis B, which means that for the pivoting movement, in respect of the first 90°, gravitational force has to be overcome, while the rest of the pivoting movement, which extends approximately over an angle range of between 10° and 20°, is assisted by gravitational force.

At the end of this pivoting movement assisted by gravitational force, the products 2 are deposited on a conveying means 6, in which case they are positioned with their surface area against said conveying means 6 and are supported at their bottom edge 4 via a supporting lug 7, which extends essentially perpendicularly to the conveying means 6 and/or to the plane of the products 2. The conveying means 6 thus continues to convey the products 2 in direction A, albeit with obliquely upright, rather than horizontal, orientation.

FIGS. 4 to 7 each show a second method step of the method according to the invention, this step immediately following the operation of raising the products 2 which takes place by overcoming gravitational force. In all the method steps according to FIGS. 4 to 7, the products 2 are pivoted further, assisted by gravitational force, through at least 90°.

FIG. 4 shows that the products 2 pivoted upward according to the invention can be deposited, for example, on a stack 8 by a further pivoting operation, assisted by gravitational force, through approximately 90°. For further processing, this stack 8 can then be separated, for example, in the downward direction (arrow D). It is also possible, however, for stackwise further processing to take place in the direction of the arrow E.

FIG. 5 shows a pivoting operation, which follows the upward pivoting operation according to the invention and is assisted by gravitational force, about the pivot axis B not just over an angle range of 90° but over an angle range of 180°. At the same time, during the pivoting of the products 2, which according to FIG. 5 are designed as folded products, these products 2 are opened. In order to allow this opening operation, during the pivoting movement, the products 2 have to have their fold region 9 oriented in the radially inward direction, with the result that the bloom 10 of the products 2 ends up in the radially outward direction during the pivoting movement.

According to FIG. 5, the products 2 are thus pivoted out of an essentially vertical position in which the fold region 9 ends up at the bottom into an again essentially vertical position, although in this case the fold region 9 ends up at the top and the bloom 10, which is now located at the bottom, is open.

Such open products 2 having the bloom 10 oriented downward can easily be deposited, at the end of the second method step illustrated in FIG. 5, on a schematically illustrated saddle conveyor 11, which then transports the products 2 in direction F, preferably perpendicular to the conveying direction A of the conveying process prior to the operation of raising the products 2 according to the invention.

FIG. 6 shows an operation, which corresponds essentially to FIG. 4 and is assisted by gravitational force, of pivoting the products 2 downward through approximately 90° and illustrates that, following this second method step, it is also possible to use a further conveying means 12, which continues to transport the products 2 in direction A of the first conveying means 1 (not illustrated in FIG. 6), there being no change in respect of the leading edge 13 between the first conveying means 1 and the further conveying means 12. It would also be possible, however, for the further conveying means 12 to be operated in the reverse direction, with the result that the products 2 are transported counter to the direction A by this conveying means 12.

Alternatively, it is also possible, as is indicated by dashed lines in FIG. 6, to provide a further conveying means 14 which, following the pivoting movement, transports the products 2 in the direction of the arrow E, the direction E being oriented perpendicularly to the direction A.

FIG. 7 illustrates that the further conveying means 14 according to FIG. 6, by virtue of being straightforwardly switched over, can also produce a product stream running in direction F, the direction F being oriented counter to the direction E according to FIG. 6.

FIG. 7 also illustrates that, by virtue of the two method steps according to the invention of raising the products 2 and then depositing them, it is possible to achieve the situation where a longer edge 15 leads in the region of the further conveying means 14, whereas, in the case of the preceding conveying process running in direction A, a shorter edge 16 leads. The method according to the invention can thus achieve the situation where a product 2 which is transported up with the shorter edge 16 leading can be transported further with a longer edge 15 leading.

It is conceivable, for example at the end of the further conveying means 14, also to provide a further apparatus for implementing the method according to the invention, which further apparatus could then, in turn, cause the products 2 to be transported further by a third conveying means with their shorter edge 16 leading or with the shorter edge 17, which is located opposite said shorter edge 16, leading.

FIG. 8 shows the end of a conveying means 1, which can be used within the context of the invention, with a wedge-shaped guide element 18 arranged in its end region.

By virtue of the movement of the products 2 in conveying direction A, the outer region of the leading edge 13 of the products 2, in relation to the following pivoting movement, moves upward along the guide element 18 and thus lifts off from the conveying means 1. The guide element 18 thus initiates the operation of raising the products 2 according to the invention and makes it possible for the products 2 to be gripped at their leading edge 13 by means of grippers (not illustrated).

FIG. 9 shows that, as an alternative to the guide element 18 according to FIG. 8, it is also possible to provide a stop 19 against which the leading edge 13 of the products 2 strikes on account of the conveying process brought about by the conveying means 1. The continued transporting movement of the product 2 then causes the product 2 to bulge out in the direction of the intended pivoting movement. This bulging out thus likewise initiates the pivoting movement according to the invention and makes it possible for the products 2 to be gripped at their leading edge 13.

FIG. 10 also shows the method according to FIG. 9, although in this case the products 2 are not pivoted directly about one of their longer edges. Rather, the pivoting movement takes place such that the radially inner longer edges of the products 2 are spaced apart from the pivot axis B.

FIG. 11 shows an upward pivoting operation through 90° according to the invention, which is guided by means of grippers, and a subsequent further pivoting operation aided by gravitational force.

The products 2 are transported up in the conveying direction A in imbricated formation by the conveying means 1, the products being positioned on the conveying means 1 such that both their bloom 10 and their fold region 9 run parallel to the conveying direction A.

At the end of the conveying means 1, the pivoting movement according to the invention is then initiated by means of a stop 19 (see FIGS. 9 and 10). The rest of the pivoting movement is brought about, according to FIG. 11, essentially by two gripper fingers 20, 21, which pivot along with the products 2. At the beginning of the pivoting movement, the opening and/or spreading element 22 is introduced into the already slightly open product 2, whereupon the two gripper fingers 20, 21 are then closed, with the result that the product 2 is retained between the two gripper fingers 20, 21. During the subsequent pivoting movement, which the products 2, gripper fingers 20, 21 and opening and/or spreading element 22 execute together, further opening of the products 2 is achieved by virtue of the opening and/or spreading elements 22 being rotated, with the result that, at the end of the pivoting movement, for example, the products 2 can easily be positioned (not illustrated) on a saddle conveyor. For such a positioning operation, however, it is necessary for the products to be pivoted through a total of approximately 270°, with the result that the open bloom 10 of the products is oriented downward. As soon as the open products 2 are positioned above a saddle conveyor—aligned with a rest of the same—the gripper fingers 20, 21 are opened, with the result that the product 2 can drop onto a saddle-like rest.

FIG. 12 illustrates an alternative method to FIG. 11 of opening the products 2 which are taking part in the pivoting process according to the invention.

According to FIG. 12, the products 2 are first of all gripped by the two gripper fingers 20, 21 in the region of their leading edge 13, in relation to the conveying means 1. While the subsequent pivoting movement is executed, an opening and/or spreading element 23 is then moved into the bloom 10 of the products 2, in the direction of the fold region 9 of the latter, perpendicularly to the longitudinal direction of the bloom 10, with the result that the bloom 10 is opened in this way.

The operation of opening products 2 according to FIGS. 11 and 12 can be carried out on products 2 with or without an overfold, in order to allow subsequent processing of the products 2.

What is claimed is:

1. A method of raising sheet-like products, in particular printed products, during a product conveying operation, comprising the steps of:

a) conveying the products sequentially, one after the other, in a conveying direction A;

b) pivoting the products actively about a pivot axis B which extends essentially parallel to the conveying direction A in which the products are being conveyed immediately prior to the pivoting operation, wherein the pivoting step comprises raising the products by pivoting the products about the pivot axis B and wherein, for at least a period of time of the pivoting operation, gravitational force is overcome, and further wherein the pivoting step comprises producing a fan-like structure having multiple fan elements, each of said multiple fan elements being formed by at least one product.

2. The method as claimed in claim 1, wherein the conveying step comprises conveying the products in an imbricated formation.

3. The method as claimed in claim 1, further comprising the step of:

a) slowing down forward movement of the product in the conveying direction and commencing a laterally oriented pivoting movement about the pivot axis B during this slowing-down step.

4. The method as claimed in claim 1, wherein the pivot axis B coincides at least essentially with a product edge which extends parallel to the conveying direction A in which the products are being conveyed immediately prior to the pivoting step.

5. The method as claimed in claim 1, further comprising the step of:

a) immediately prior to the beginning of the pivoting step, orienting the products horizontally or in a manner inclined in relation to the horizontal.

6. The method as claimed in claim 1, further comprising the step of:

a) pivoting the products through an angle between 10° and 90° during the pivoting step.

7. The method as claimed in claim 1, further comprising the step of:

a) moving the products, at the beginning of the raising step, by way of their leading edge, along an in particular stationary guide element, with the result that the products, at least in certain regions, lift off from the conveyor in the pivoting direction.

8. The method as claimed in claim 1 further comprising the steps of:

a) raising the products into an at least essentially vertically oriented position;

b) pivoting the products downward, assisted by gravitational force, about the pivot axis B of the pivoting operation, in particular through an angle range of between 90° and 180°; and c) depositing the products.

9. The method as claimed in claim 1, further comprising the step of:

a) retaining the products while they are being raised during the pivoting step, in particular at their leading edge, as seen relative to the conveying direction A, by supporting means or grippers which cause the products to pivot.

10. The method as claimed in claim 9, further comprising the step of:

a) moving the supporting means or grippers along a closed circulatory path about the pivot axis B.

11. The method as claimed in claim 1, further comprising the step of:

a) moving the products at the beginning of the pivoting operation, by means of their leading edge, against a stationary stop, with the result that the products, at least in certain regions, lift off from the convey or in a pivoting direction.

12. The method as claimed in claim 11, further comprising the step of:

a) conveying products having an overfold, an overfold region, a leading edge and a region opposite the overfold; and b) moving said products at the beginning of the pivoting step against a stop by way of the leading edge of the overfold region, with the result that a region of the products which is located opposite the overfold lifts off from the overfold region in the pivoting direction and the products are opened.

13. The method as claimed in claim 1, further comprising the step of:

a) gripping the products, once the products have been raised into an at least essentially vertically oriented position, individually by grippers, in particular at the upwardly oriented edge of each product;

b) conveying the products in a gripper conveying direction C; and c) feeding the products to a further processing unit.

14. The method as claimed in claim 13, wherein the gripper conveying direction C runs essentially perpendicularly to the conveying direction A in which the products are being conveyed immediately prior to the pivoting step.

15. The method as claimed in claim 1, further comprising the step of:

a) depositing the products on a further conveyor or a product stack.

16. The method as claimed in claim 15, wherein a conveying direction F, E of the further conveyor runs essentially perpendicularly to the conveying direction A in which the products are being conveyed immediately prior to the pivoting step.

17. The method as claimed in claim 15, wherein the products are deposited on a pocket and/or saddle conveyor or on a conveying belt.

18. The method as claimed in claim 1 further comprising step of:

a) processing the products during the pivoting step, in particular by opening, stapling, cutting or addressing.

19. The method as claimed in claim 18, further comprising the step of:

a) opening folded products during the pivoting step, the fold region of the products ending up in the radially inward direction in relation to the pivoting movement.

20. The method as claimed in claim 19, further comprising the step of:

a) inserting further products into already open products during the pivoting step.

21. An apparatus for raising sheet-like products, in particular printed products, which are taking part in a conveying process and follow sequentially one after the other, comprising:

a) a conveyor for conveying products resting at least partially on it in a conveying direction A; and b) a plurality of supporting means or grippers which run around a pivot axis B, running essentially parallel to the conveying direction A, and by means of which the products are retained and pivoted about the pivot axis B, thereby producing a fan-like structure having multiple fan elements during the pivoting operation and wherein each of said multiple fan elements is formed by at least one product.

22. An apparatus as claimed in claim 21, wherein the conveyor is able to convey the products in an imbricated formation.

23. An apparatus as claimed in claim 21, wherein the supporting means or grippers are able to retain a product at the leading edge of said product, as seen in the conveying direction A.

24. An apparatus as claimed in claim 21, wherein the supporting means or grippers are arranged to be movable along a closed circulatory path about the pivot axis B.

* * * * *